US010767645B2

(12) United States Patent
Sakai et al.

(10) Patent No.: US 10,767,645 B2
(45) Date of Patent: Sep. 8, 2020

(54) FUEL PUMP

(71) Applicant: DENSO CORPORATION, Kariya, Aichi-pref. (JP)

(72) Inventors: Hiromi Sakai, Kariya (JP); Daiji Furuhashi, Kariya (JP)

(73) Assignee: DENSO CORPORATION, Kariya (JP)

( * ) Notice: Subject to any disclaimer, the term of this patent is extended or adjusted under 35 U.S.C. 154(b) by 174 days.

(21) Appl. No.: 15/569,200

(22) PCT Filed: Apr. 19, 2016

(86) PCT No.: PCT/JP2016/002088
§ 371 (c)(1),
(2) Date: Oct. 25, 2017

(87) PCT Pub. No.: WO2017/010028
PCT Pub. Date: Jan. 19, 2017

(65) Prior Publication Data

US 2018/0112659 A1 Apr. 26, 2018

(30) Foreign Application Priority Data

Jul. 16, 2015 (JP) ..... 2015-142167

(51) Int. Cl.
*F04C 2/10* (2006.01)
*F04C 11/00* (2006.01)
(Continued)

(52) U.S. Cl.
CPC ..... *F04C 2/102* (2013.01); *F02M 37/041* (2013.01); *F02M 37/08* (2013.01); *F04C 11/008* (2013.01);
(Continued)

(58) Field of Classification Search
CPC ..... F04C 2/10; F04C 2/102–103; F04C 15/0049; F04C 15/0057–0061;
(Continued)

(56) References Cited

U.S. PATENT DOCUMENTS 4,820,138 A * 4/1989 Bollinger ..... F04C 15/0042 418/171
5,340,293 A * 8/1994 Yasuda ..... F04C 2/102 418/171
2002/0122736 A1* 9/2002 Takagi ..... F04C 2/102 418/171

FOREIGN PATENT DOCUMENTS

JP 61-155684 9/1986
JP 2002-005039 1/2002
(Continued)

*Primary Examiner* — Alexander B Comley
(74) *Attorney, Agent, or Firm* — Nixon & Vanderhye P.C.

(57) ABSTRACT

A fuel pump includes: an outer gear having a plurality of inner teeth; an inner gear having a plurality of outer teeth and eccentrically meshing with the outer gear; and a pump housing that defines a cylindrical gear housing chamber housing the outer gear and the inner gear to be rotatable. The outer gear and the inner gear rotate, while expanding and contracting a volume of a plurality of pump chambers formed between the outer gear and the inner gear, to sequentially draw fuel into and discharge from the pump chamber. An inner circumference part of the pump housing has a radially-inside corner part opposing a radially-outside corner part of an outer circumference part of the outer gear, and the pump housing has an annular groove formed in an annular shape all around the radially-inside corner part.

7 Claims, 7 Drawing Sheets

(51) Int. Cl.

| | |
|---|---|
| ***F04C 15/00*** | (2006.01) |
| ***F02M 37/08*** | (2006.01) |
| ***F02M 37/04*** | (2006.01) |
| ***F04C 15/06*** | (2006.01) |
| ***F02M 37/10*** | (2006.01) |
| ***F04C 2/08*** | (2006.01) |

(52) U.S. Cl.
CPC ..... *F04C 15/0049* (2013.01); *F04C 15/06* (2013.01); *F02M 37/10* (2013.01); *F04C 2/086* (2013.01); *F04C 2210/203* (2013.01); *F04C 2240/54* (2013.01); *F04C 2240/56* (2013.01)

(58) Field of Classification Search
CPC ..... F04C 15/06; F04C 2/086; F04C 11/008; F04C 2210/203; F02M 37/041; F02M 37/08
USPC ..... 418/171, 205–206.1, 206.6–206.8
See application file for complete search history.

(56) References Cited

FOREIGN PATENT DOCUMENTS

| | | | |
|---|---|---|---|
| JP | 2007-085259 | | 4/2007 |
| JP | 2007-248422 | * | 4/2007 |
| JP | 2008-001251 | | 1/2008 |
| JP | 2008-038789 | | 2/2008 |
| JP | 2009-144689 | | 7/2009 |
| JP | 2011-032892 | | 2/2011 |
| JP | 2011-122548 | | 6/2011 |
| JP | 2013-060901 | | 4/2013 |

* cited by examiner

FUEL PUMP

CROSS REFERENCE TO RELATED APPLICATION

This application is the U.S. national phase of International Application No. PCT/JP2016/002088 filed Apr. 19, 2016, which designated the U.S. and claims priority to Japanese Patent Application No. 2015-142167 filed on Jul. 16, 2015, the entire contents of each of which are incorporated herein by reference.

TECHNICAL FIELD

The present disclosure relates to a fuel pump that draws fuel into a gear housing chamber and discharges the fuel.

BACKGROUND ART

Patent Literature 1 discloses a pump that draws fuel into a gear housing chamber and discharges the fuel. The pump includes: an outer gear having inner teeth; an inner gear having outer teeth and meshing with the outer gear in eccentric state; and a pump housing that defines a cylindrical gear housing chamber housing the outer gear and the inner gear to be rotatable from both sides in the axial direction. The outer gear and the inner gear rotate, while expanding and contracting a volume of a pump chamber formed plurally between the outer gear and the inner gear, to sequentially draw fluid into and discharge from each of the pump chambers.

The pump housing has a spiral-shaped groove formed from a radially-inside corner part opposing a radially-outside corner part of the outer gear toward a central part.

PRIOR ART LITERATURES

Patent Literature

Patent Literature 1: JP 2009-144689 A

SUMMARY OF INVENTION

However, a complicated processing is required for forming the spiral-shaped groove. Moreover, it is difficult to fully absorb a positional deviation of the outer gear which may be produced, for example, when fuel is discharged out of a pump chamber, and pulsation cannot fully be controlled. As a result, a fuel pump having a high pump efficiency cannot be offered.

The purpose of the present disclosure is to provide a fuel pump having high pump efficiency.

According to an aspect of the present disclosure, a fuel pump includes: an outer gear having a plurality of inner teeth; an inner gear having a plurality of outer teeth and eccentrically meshing with the outer gear; and a pump housing that defines a cylindrical gear housing chamber housing the outer gear and the inner gear to be rotatable, from both sides in an axial direction. The outer gear and the inner gear rotate, while expanding and contracting a volume of a plurality of pump chambers formed between the outer gear and the inner gear, to sequentially draw fuel into and discharge from each of the pump chambers. An inner circumference part of the pump housing has a radially-inside corner part opposing a radially-outside corner part of an outer circumference part of the outer gear. The pump housing has an annular groove formed in an annular shape all around the radially-inside corner part.

Accordingly, the pump housing defines the cylindrical gear housing chamber. The gear housing chamber houses both the gears to be rotatable by sandwiching the outer gear and the inner gear from both sides in the axial direction. When the outer gear and the inner gear rotate, fuel is sequentially drawn into the pump chamber between the gears and is discharged. A positional deviation such as inclination of the outer gear may occur, for example, at a time of the discharging.

In the present disclosure, the pump housing has the annular groove formed in the annular shape around all the circumferences of the radially-inside corner part opposing the radially-outside corner part of the outer gear. If a position deviation of the outer gear occurs in a state where fuel has flowed into the annular groove through a clearance between the gears and the pump housing, damper effect can be applied to the outer circumference part of the outer gear to resolve the positional deviation by the fuel in the annular groove. A pulsation caused by rotation of the outer gear and the inner gear can be eased by the annular groove, and the sliding resistance can be restricted because the outer gear and the inner gear rotate stably. Accordingly, a fuel pump with high pump efficiency can be offered.

DESCRIPTION OF EMBODIMENTS

Figure 1:
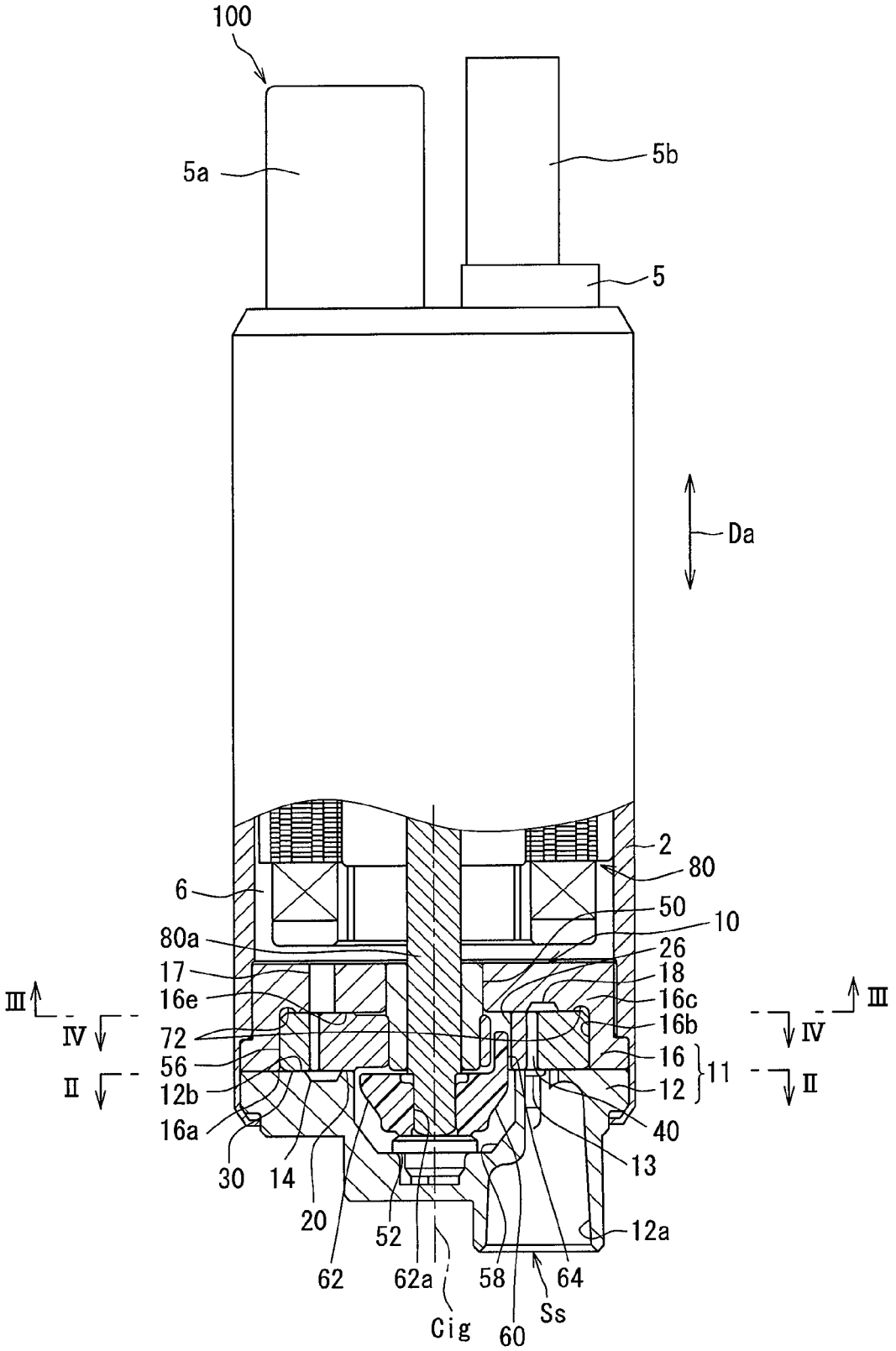
FIG. 1 is a partial sectional view illustrating a fuel pump according to a first embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A fuel pump 100 according to a first embodiment is a trochoid pump of positive displacement, as shown in FIG. 1. The fuel pump 100 is a diesel pump mounted in a vehicle, and is used for pumping light oil having viscosity higher than gasoline, for combustion in an internal-combustion engine. The fuel pump 100 includes an electric motor 80 and a pump main part 10 housed inside a cylindrical pump body 2, and a side cover 5 is projected outward away from the pump main part 10 while the electric motor 80 is interposed between the side cover 5 and the pump main part 10 in the axial direction Da. In the fuel pump 100, a rotation shaft 80*a* of the electric motor 80 is driven to rotate through an electric connector 5*a* of the side cover 5. An outer gear 30 and an inner gear 20 rotate using the driving force of the rotation shaft 80*a* in the pump main part 10. Light oil corresponding to fuel is drawn into a gear housing chamber 56 housing both the gears 20 and 30, pressurized, and discharged out of the gear housing chamber 56 to flow through a fuel passage 6 and a discharge port 5*b* of the side cover 5.

In this embodiment, an inner rotor type brushless motor is adopted as the electric motor 80, in which a four-pole magnet and a six-slot coil are arranged. For example, when the ignition of a vehicle is turned on, or when the accelerator of a vehicle is pressed, a positioning control is performed by the electric motor 80 by rotating the rotation shaft 80*a* to a drive rotation side or a drive rotation reverse side. Then, a drive control is performed to rotate the rotation shaft 80*a* to the drive rotation side from the position positioned in the positioning control.

The drive rotation side represents a side corresponding to a forward direction of a rotational direction Rig to be mentioned later (see FIG. 4). The drive rotation reverse side represents a side corresponding to a reverse direction of the rotational direction Rig (see FIG. 4).

Hereafter, the pump main part 10 is explained in detail, also using FIGS. 2-7. The pump main part 10 includes a pump housing 11, an inner gear 20, a joint component 60, and an outer gear 30.

The pump housing 11 has a pump cover 12 and a pump casing 16 arranged in the axial direction Da to define a cylindrical gear housing chamber 56 housing both the gears 20 and 30 to be rotatable, from both sides in the axial direction Da.

Figure 2:
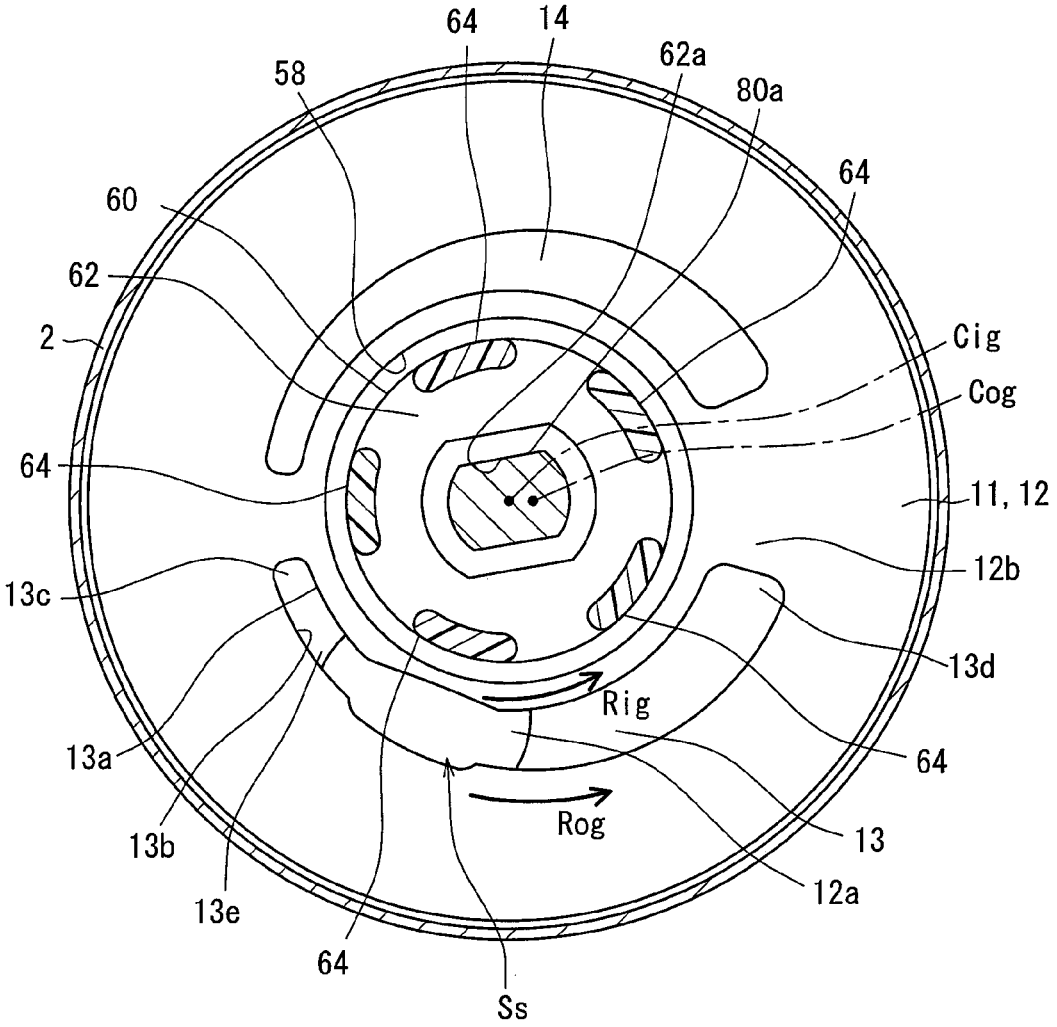
FIG. 2 is a cross-sectional view taken along a line II-II of FIG. 1.
Figure 4:
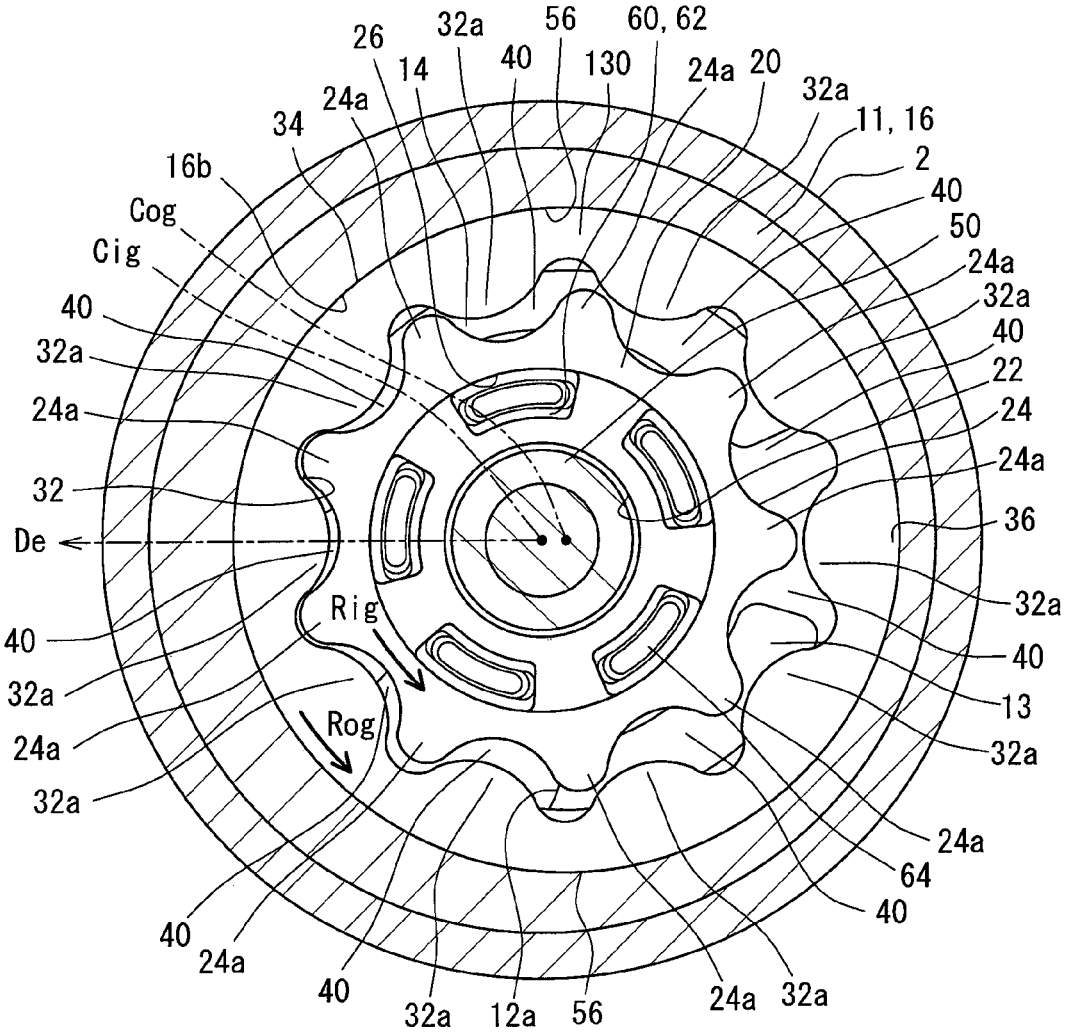
FIG. 4 is a cross-sectional view taken along a line IV-IV of FIG. 1.

The pump cover 12 shown in FIGS. 1-2, and 4 is one component of the pump housing 11. The pump cover 12 is formed in a disk shape having wear resistance by performing surface treatments, such as plating, to a base material made of metal which has rigidity, such as steel material. The pump cover 12 is projected outward from the end of the pump body 2 away from the electric motor 80 in the axial direction Da.

The pump cover 12 defines a cylindrical intake port 12*a* and an intake passage 13 having an arc groove shape, to draw fuel from the outside. The intake port 12*a* passes through the pump cover 12 in the axial direction Da, at a specific opening part Ss eccentrically arranged relative to an inner central line Cig of the inner gear 20. The intake passage 13 is defined in the pump cover 12, and faces the gear housing chamber 56. As shown in FIG. 2, an inner periphery edge 13*a* of the intake passage 13 is extended in the rotational direction Rig of the inner gear 20 with a length less than the semicircle. An outer periphery edge 13*b* of the intake passage 13 is extended in the rotational direction Rog of the outer gear 30 (see FIG. 4) with a length less than the semicircle.

The width of the intake passage 13 is increased as extending from a start end 13*c* to a finish end 13*d* in the rotational direction Rig, Rog. Moreover, the intake passage 13 communicates with the intake port 12*a*, since the intake port 12*a* is defined at the opening part Ss of the slot bottom 13*e*. As shown in FIG. 2, the width of the intake passage 13 is set smaller than the width of the intake port 12*a* throughout the opening part Ss where the intake port 12*a* is open.

The pump casing 16 shown in FIGS. 1, and 3-6 is one component of the pump housing 11. The pump casing 16 is formed in a based cylindrical shape having wear resistance by performing surface treatments, such as plating, to a base material made of metal which has rigidity, such as steel material. An opening 16*a* of the pump casing 16 is covered with the pump cover 12, so as to be closed all the circumferences. An inner circumference part 22 of the pump casing 16 is formed in a cylindrical bore shape arranged eccentrically relative to the inner central line Cig.

Figure 3:
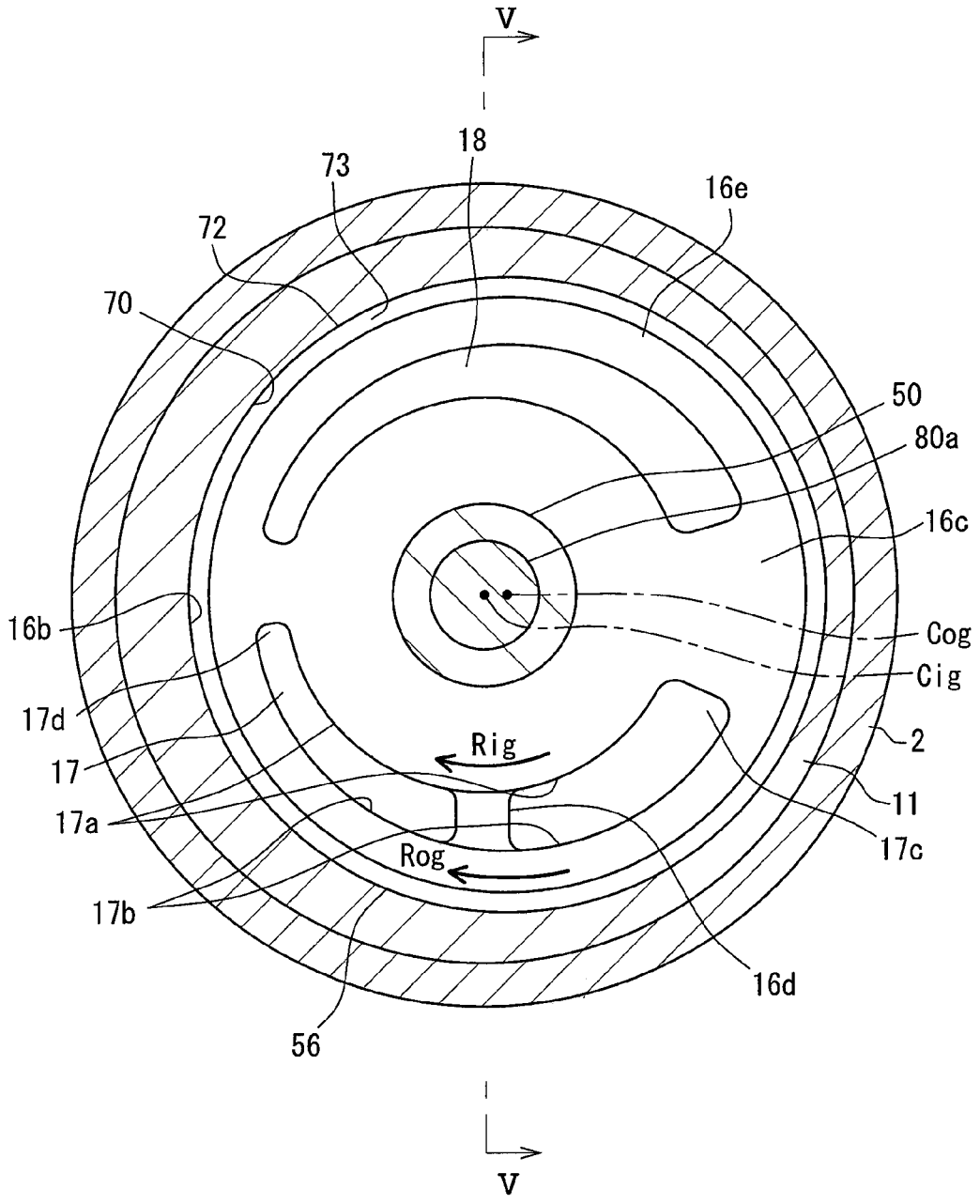
FIG. 3 is a cross-sectional view taken along a line of FIG. 1.

The pump casing 16 defines a discharge passage 17 having an arc hole shape to discharge fuel from the gear housing chamber 56. The discharge passage 17 passes through a concave bottom part 16*c* of the pump casing 16 in the axial direction Da. As shown in FIG. 3, an inner periphery edge 17*a* of the discharge passage 17 is extended in the rotational direction Rig of the inner gear 20 with a length less than the semicircle. An outer periphery edge 17*b* of the discharge passage 17 is extended in the rotational direction Rog of the outer gear 30 with a length less than the semicircle. The width of the discharge passage 17 is decreased as extending from a start end 17*c* to a finish end 17*d* in the rotational direction Rig, Rog.

The pump casing 16 has a reinforcing rib 16*d* at the discharge passage 17. The reinforcing rib 16*d* is formed integrally with the pump casing 16, and reinforces the pump casing 16 by extending over the discharge passage 17 in a direction intersecting the rotational direction Rig of the inner gear 20.

As shown in FIG. 3, the concave bottom part 16*c* of the pump casing 16 has an intake groove 18 having an arc shape and opposing the intake passage 13 across a pump chamber 40 defined between the gears 20 and 30 (to be explained in detail) to correspond with the form of the intake passage 13 projected in the axial direction Da. Thereby, the discharge passage 17 and the intake groove 18 are formed symmetric with respect to a line symmetry in the outline at a side of the pump casing 16 adjacent to the gear housing chamber 56.

A sliding surface part 16*e* of the concave bottom part 16*c* has a plane shape, and slides with the inner gear 20 which rotates at the inner circumference side, and slides with the outer gear 30 which rotates at the outer circumference side.

As shown in FIG. 2, the pump cover 12 has a discharge groove 14 having an arc shape at a position opposing the discharge passage 17 across the pump chamber 40 to correspond with the form of the discharge passage 17 projected in the axial direction Da. Thereby, the intake passage 13 and the discharge groove 14 are formed symmetric with respect to a line symmetry in the outline through the joint housing chamber 58 at a side of the pump cover 12 adjacent to the gear housing chamber 56.

The joint housing chamber 58 is recessed in the axial direction Da from the sliding surface part 12*b* of the pump cover 12 at a position opposing the inner gear 20 on the inner central line Cig. In this way, the joint housing chamber 58 communicates with the gear housing chamber 56, at one side of the gear housing chamber 56 in the axial direction Da, thereby housing rotatably the main body 62 of the joint component 60 to be mentioned later.

The sliding surface part 12*b* of the pump cover 12 has a plane shape adjacent to the gear housing chamber 56, and slides with the inner gear 20 which rotates at the inner circumference side, and slides with the outer gear 30 which rotates at the outer circumference side.

As shown in FIG. 1, a radial bearing 50 is fixed by fitting with the concave bottom part 16*c* of the pump casing 16 on the inner central line Cig, and supports the rotation shaft 80*a* of the electric motor 80 in the radial direction, while the rotation shaft 80*a* passes through the concave bottom part 16*c*. Further, a thrust bearing 52 is fixed by fitting with the pump cover 12 on the inner central line Cig, and supports the rotation shaft 80*a* in the axial direction Da.

Figure 5:
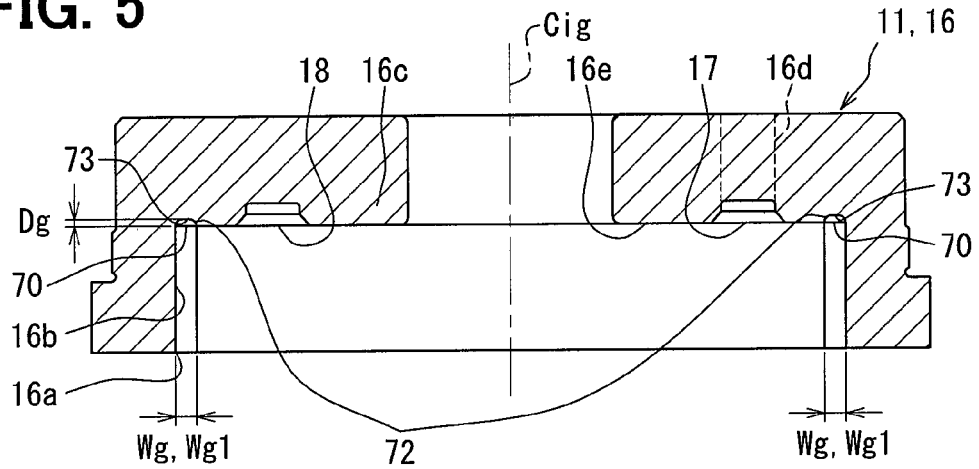
FIG. 5 is a cross-sectional view illustrating a pump casing of the first embodiment, which is taken along a line V-V of FIG. 3.

Moreover, as shown in FIGS. 2 and 5, the pump casing 16 has a radially-inside corner part 70 at a location where the inner circumference part 22 and the sliding surface part 16*e* of the concave bottom part 16*c* are connected to each other in an annular shape. The pump casing 16 has an annular groove 72 at the radially-inside corner part 70. That is, the annular groove 72 is formed at a side opposite from the joint housing chamber 58 through the gear housing chamber 56 in the axial direction Da.

Figure 6:
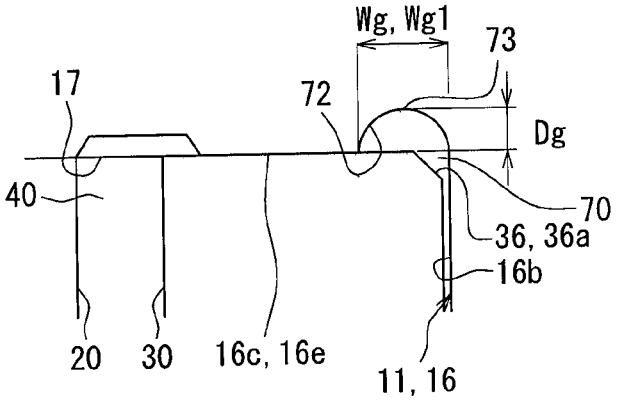
FIG. 6 is an enlarged view illustrating a part of FIG. 5 with an outer gear.
Figure 7:
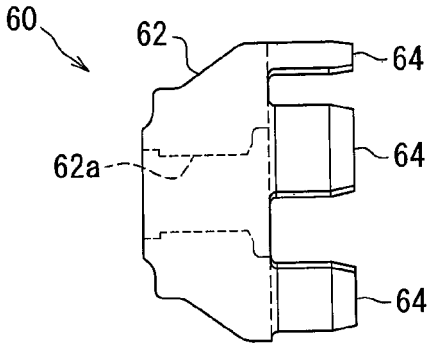
FIG. 7 is a front view illustrating a joint component of the first embodiment.

Specifically, the annular groove 72 is formed in the annular shape all around the circumference. The annular groove 72 of this embodiment is recessed from the outermost circumference of the concave bottom part 16*c* in the axial direction Da away from the gear housing chamber 56. As shown in FIG. 6, which is an enlarged view, a bottom 73 of the annular groove 72 is formed in an arc shape in the cross-section vertically along the radial direction of the pump casing 16. The arc shape in this embodiment is an ellipse shape.

The annular groove 72 is formed to have a width dimension Wg and a depth dimension Dg which are set approximately uniform all around the circumference. As shown in FIG. 5, a width dimension Wg1 of a portion open to the gear housing chamber 56 is larger than twice of the depth dimension Dg, and smaller than or equal to three times of the depth dimension Dg.

Each of the inner gear 20 and the outer gear 30 is a trochoid gear in which teeth are made to have trochoid curves.

Specifically, the inner gear 20 shown in FIGS. 1 and 4 is arranged eccentrically in the gear housing chamber 56 by setting the inner central line Cig to be in common with the rotation shaft 80*a*. Moreover, the thickness dimension of the inner gear 20 is formed slightly smaller than the corresponding dimension of the cylindrical gear housing chamber 56. In this way, the inner circumference part 22 of the inner gear 20 is supported by the radial bearing 50 in the radial direction, and the both sides in the axial direction Da are respectively supported by the sliding surface part 16*e* of the pump casing 16 and the sliding surface part 12*b* of the pump cover 12.

Moreover, the inner gear 20 has the insertion hole 26 recessed in the axial direction Da at a position opposing the joint housing chamber 58. The insertion hole 26 is defined at plural positions in the circumference direction at equal intervals, and each of the insertion holes 26 passes through the inner gear to a position adjacent to the concave bottom part 16*c*.

The joint component 60 shown in FIGS. 1, 2, 4, and 7 is formed, for example, of synthetic resins, such as polyphenylene sulfide (PPS) resin, and rotates both the gears 20 and 30 by connecting the rotation shaft 80*a* to the inner gear 20. The joint component 60 has the main body 62 and the insertion part 64. The main body 62 is fitted with the rotation shaft 80*a* through the fitting hole 62*a* in the joint housing chamber 58. The insertion part 64 is formed at plural locations corresponding to the insertion holes 26. Specifically, the number of the insertion holes 26 or the insertion parts 64 of this embodiment is five which is a prime number by avoiding the number of poles and the number of slots of the electric motor 80 to reduce the influence of torque ripple of the electric motor 80. Each of the insertion parts 64 is extended in the axial direction Da from a position on the outer circumference side of the fitting hole 62*a* of the main body 62.

The insertion part 64 is inserted in the corresponding insertion hole 26 through a clearance. When the rotation shaft 80*a* rotates to the drive rotation side, the insertion part 64 pushes on the insertion hole 26, thereby transmitting the driving force of the rotation shaft 80*a* to the inner gear 20 through the joint component 60. That is, the inner gear 20 is rotatable in the rotational direction Rig about the inner central line Cig.

The outer circumference part 24 of the inner gear 20 has the outer teeth 24*a* arranged in the rotational direction Rig at equal intervals. The outer teeth 24*a* are able to oppose each of the passages 13, 17 and each of the grooves 14, 18 in the axial direction Da, in response to rotation of the inner gear 20, so as to be restricted from adhering onto the sliding surface part 12*b*, 16*e*.

As shown in FIGS. 1 and 4, the outer gear 30 is eccentric to the inner central line Cig of the inner gear 20, and is arranged coaxially in the gear housing chamber 56. Thereby, the inner gear 20 is eccentric to the outer gear 30 in an eccentric direction De as one radial direction of the outer gear 30.

The outer diameter and the thickness dimension of the outer gear 30 are slightly smaller than the corresponding dimensions of the cylindrical gear housing chamber 56. In this way, the outer circumference part 34 of the outer gear 30 is supported by the inner circumference part 16*b* of the pump casing 16, and the both side in the axial direction Da are respectively supported by the sliding surface parts 12*b* and 16*e*. Moreover, the outer circumference part 34 of the outer gear 30 has the radially-outside corner part 36 opposing the radially-inside corner part 70 of the pump housing 11. The radially-outside corner part 36 of the outer gear 30 has a chamfering part 36*a* shaped in a taper shape all around the circumference. Thus, the outer gear 30 is rotatable in the fixed rotational direction Rog about the outer central line Cog which is eccentric from the inner central line Cig, with the inner gear 20.

The inner circumference part 32 of the outer gear 30 has the inner teeth 32*a* arranged in the rotational direction Rog at equal intervals. The number of the inner teeth 32*a* of the outer gear 30 is set to be larger than the number of the outer teeth 24*a* of the inner gear 20 by one. In this embodiment, the number of the inner teeth 32*a* is ten, and the number of the outer teeth 24*a* is nine. Each of the inner teeth 32*a* is able to oppose each of the passages 13, 17, and each of the grooves 14, 18 in the axial direction Da, in response to rotation of the outer gear 30, so as to be restricted from adhering onto the sliding surface part 12*b*, 16*e*.

The inner gear 20 meshes with the outer gear 30 due to the relative eccentricity in the eccentric direction De. Thereby, plural pump chambers 40 are formed to continue with each other, between the gears 20 and 30 in the gear housing chambers 56. When the outer gear 30 and the inner gear 20 rotate, the volume of the pump chambers 40 expands and contracts.

The volume of the pump chamber 40 communicated with the intake passage 13 and the intake groove 18 by opposing is expanded in response to rotation of both the gears 20 and 30. As the result, fuel is drawn from the intake port 12*a* through the intake passage 13 into the pump chamber 40 inside the gear housing chamber 56. At this time, since the width of the intake passage 13 is increased as extending from the start end 13*c* to the finish end 13*d* (see FIG. 2), the amount of fuel drawn through the intake passage 13 corresponds to the increase in the volume of the pump chamber 40.

The volume of the pump chamber 40 communicated with the discharge passage 17 and the discharge groove 14 by opposing decreased in response to rotation of both the gears 20 and 30. As the result, simultaneously with the intake function, fuel is discharged out of the gear housing chamber 56 through the discharge passage 17 from the pump chamber 40. At this time, since the width of the discharge passage 17 is decreased as extending from the start end 17*c* to the termination part 17*d* (see FIG. 3), the amount of fuel discharged out through the discharge passage 17 corresponds to the decrease in the volume of the pump chamber 40.

Thus, the fuel sequentially drawn through the intake passage 13 into the pump chamber 40 and discharged out through the discharge passage 17 is discharged out from the discharge port 5*b* through the fuel passage 6. Due to the above-mentioned pumping action, a pressure of fuel adjacent to the discharge passage 17 becomes higher than a pressure of fuel adjacent to the intake passage 13.

On the other hand, a part of the fuel drawn into the gear housing chamber 56 leaks from each of the pump chambers 40 due to a dimension relationship between the outer gear 30 and the inner gear 20, and the gear housing chamber 56. The leak fuel forms an oil film between the gear 20, 30 and the sliding surface part 12*b*, 16*e*, and flows into the joint housing chamber 58 and the annular groove 72.

The annular groove 72 exists to make an area on a radially outer side of the intake passage 13 and an area on a radially outer side of the discharge passage 17 to communicate with each other. Further, due to the setting of the width dimension Wg1 of the annular groove 72, a distance between the pump chamber 40 and the annular groove 72 becomes the optimal, for securing the sealing of the pump chamber 40, to adjust the inflow amount of the fuel to the annular groove 72. As a result, comparatively uniform fuel pressure can be maintained in the annular groove 72 where fuel flowed in, all around the circumference.

Now, one pump chamber 40 formed between the gears 20 and 30 inside the gear housing chamber 56 is moved from the intake passage 13 toward the discharge passage 17 in response to rotation of both the gears 20 and 30. When both the gears 20 and 30 reach a predetermined phase, the pump chamber 40 communicates with the discharge passage 17. At the moment of the communication, reaction caused by fuel discharged to the discharge passage 17 acts on the outer gear 30 and the inner gear 20. The reaction may be produced at the same number as the number of the outer tooth 24*a* per one rotation of the inner gear 20 (nine times in this embodiment).

The action and effect in the first embodiment is explained below.

According to the first embodiment, the pump housing 11 defines the cylindrical gear housing chamber 56. The gear housing chamber 56 houses both the gears 20 and 30 to be rotatable from both sides in the axial direction Da. When the outer gear 30 and the inner gear 20 rotate, fuel is drawn sequentially into the pump chamber 40 between the gears 20 and 30 and is discharged. A positional misalignment such as inclination of the outer gear 30 may occur at a time of the discharging.

In the fuel pump 100, the pump casing 16 of the pump housing 11 has the annular groove 72, at the radially-inside corner part 70 opposing the radially-outside corner part 36 of the outer gear 30, formed in the annular shape all around the circumference. When a positional misalignment of the outer gear 30 occurs in the state where fuel flowed into the annular groove 72 through the clearance between the gears 20, 30 and the pump housing 11, the fuel which flowed into the annular groove 72 causes the damper effect to the outer circumference of the outer gear 30 to correct the positional misalignment. The annular groove 72 can ease pulsation generated in response to rotation of the outer gear 30 and the inner gear 20, and the sliding resistance can be reduced because the outer gear 30 and the inner gear 20 rotate stably. By the above, the fuel pump 100 can be offered with high pump efficiency.

According to the first embodiment, the annular groove 72 is recessed toward the axial direction Da. When the position of the outer gear 30 is displaced, the fuel which flowed in the annular groove 72 can apply an action pressure to the outer gear 30 in the axial direction Da. Thereby, the damper effect can be efficiently exerted on the outer circumference of the outer gear 30.

According to the first embodiment, the joint housing chamber 58 housing the joint component 60 communicates with the gear housing chamber 56, at one side of the gear housing chamber 56 in the axial direction Da, and the annular groove 72 is formed at a side opposite from the joint housing chamber 58. The fuel which flowed into the joint housing chamber 58, and the fuel which flowed into the annular groove 72 exert the damper effect on the outer gear 30 and the inner gear 20 from both sides, such that the balance between the gears 20 and 30 can be maintained in the axial direction Da. Therefore, the sliding resistance can be reduced at a time of rotating both the gears 20 and 30. By the above, the pump efficiency increases.

According to the first embodiment, the insertion part 64 extended in the axial direction Da from the main body 62 of the joint component 60 is inserted in the insertion hole 26 of the inner gear 20 recessed in the axial direction Da, through a clearance. When the rotation shaft 80*a* is axially misaligned, for example, by vibration of a vehicle, the axial misalignment can be absorbed by the clearance adjacent to the insertion hole 26. Therefore, since the sliding resistance can be reduced at a time of rotating the outer gear 30 and the inner gear 20, the pump efficiency increases.

According to the first embodiment, the bottom 73 of the annular groove 72 has an arc shape in the cross-section. Since a flow of the fuel at the bottom 73 becomes smooth by the annular groove 72 having the cross-section shaped in the arc, the action pressure can be efficiently transmitted to the outer circumference of the outer gear 30.

Second Embodiment

Figure 8:
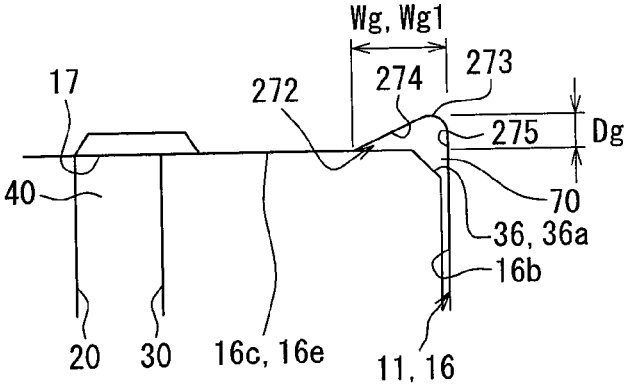
FIG. 8 is a view of a second embodiment corresponding to FIG. 6.
Figure 9:
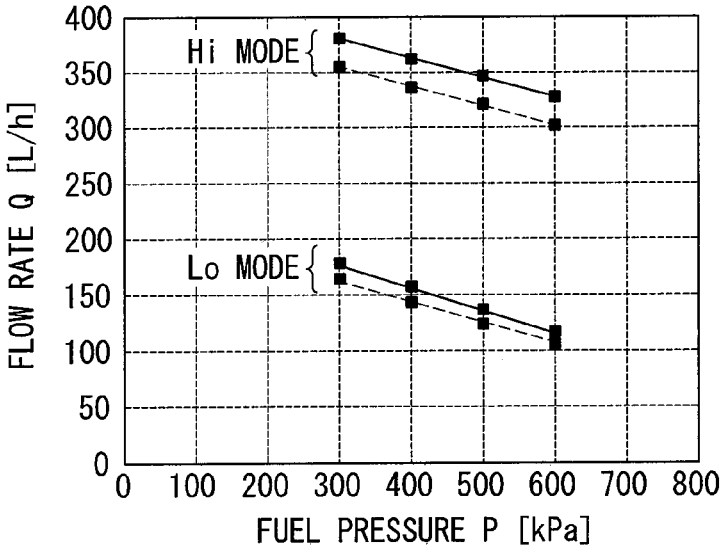
FIG. 9 is a graph illustrating a comparison in flow rate in experiments between the fuel pump of the second embodiment and a fuel pump of a comparative example not having an annular groove.
Figure 10:
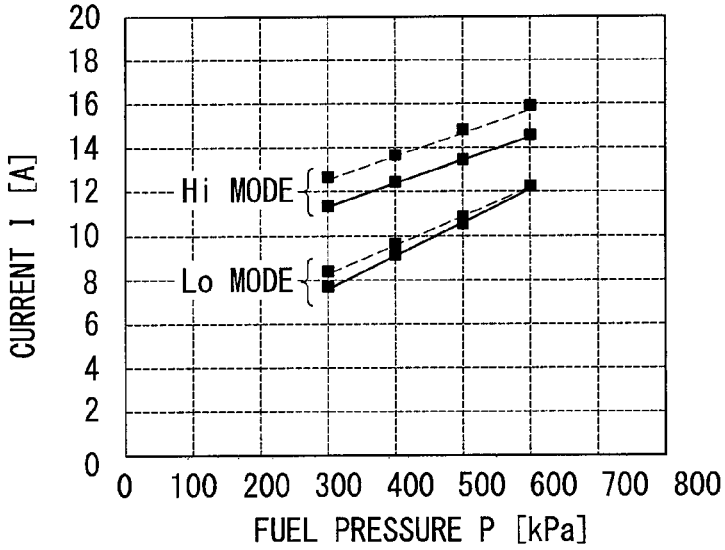
FIG. 10 is a graph illustrating a comparison in current value in experiments between the fuel pump of the second embodiment and a fuel pump of a comparative example not having an annular groove.

As shown in FIGS. 8-10, a second embodiment is a modification of the first embodiment. The second embodiment is described focusing on a different point from the first embodiment.

The annular groove 272 in the fuel pump 200 of the second embodiment is formed in the annular shape all around the circumference, similarly to the first embodiment. As shown in FIG. 8, the annular groove 272 is recessed from the outermost circumference of the concave bottom part 16*c* in the axial direction Da away from the gear housing chamber 56.

The annular groove 272 is formed so that each of the width dimension Wg and the depth dimension Dg is approximately uniform all around the circumference. However, the width of the annular groove 272 in one radial direction is made smaller as extending to the bottom 273. Specifically, the annular groove 272 of the second embodiment is shaped in a triangle tapering as extending to the bottom 273 in the cross-section vertically along the radial direction of the pump casing 16. An external wall 275 of the annular groove 272 is formed to extend in the axial direction Da, and an internal wall 274 of the annular groove 272 inclines to the outer circumference side as extending to the bottom 273. The bottom 273 of the annular groove 272 has an arc shape in the cross-section, similarly to the first embodiment.

Results of comparison experiments are explained below using FIGS. 9 and 10, between the fuel pump 200 of the present embodiment and a fuel pump of a comparative example in which the annular groove 272 is not formed in the fuel pump 200. The comparison experiments were conducted on the conditions at which the fuel is JIS No. 2 light oil and the fuel temperature is 25° C. In FIGS. 9 and 10, Hi mode represents a case where the supply voltage to the electric motor 80 is 12V, for example, used in the state of a full throttle. Lo mode represents a case where the supply voltage to the electric motor 80 is 6V, for example, used in the state of an idling. The fuel pressure in FIGS. 9 and 10 represents a fuel pressure adjusted in a pressure regulator of an internal-combustion engine. In FIGS. 9 and 10, a solid line represents data of the fuel pump 200 of the present embodiment, and a dashed line represents data of the comparative example.

In FIG. 9, the flow rate of the present embodiment is higher than the flow rate of the comparative example, at each fuel pressure, in each mode. In FIG. 10, the current value of the present embodiment is less than the current value of the comparative example at each fuel pressure in the Hi mode. In the Lo mode, when the fuel pressure is 600 kPa, there is no significant difference in the current value between of the present embodiment and the comparative example, but the current value of this embodiment becomes lower than the current value of the comparative example as the fuel pressure is lowered.

According to the second embodiment, since the pump casing 16 of the pump housing 11 has the annular groove 272 formed in the annular shape all around the circumference, at the radially-inside corner part 70, it becomes possible to achieve the action and effect similar to the first embodiment.

According to the second embodiment, the annular groove 272 has the triangle shape which tapers off as extending to the bottom 273, in the cross-section. Therefore, since the volume of the annular groove 272 can be reduced relative to a pressure receiving area at the position where the annular groove 272 opposes the outer gear 30, the action pressure can be efficiently transmitted to the outer circumference of the outer gear 30, while controlling the leak amount of the fuel to the annular groove 272.

Other Embodiment

The present disclosure is not limited to the embodiments, and can be applied to various embodiment and combination within a range not deviated from the scope of the present disclosure.

Figure 11:
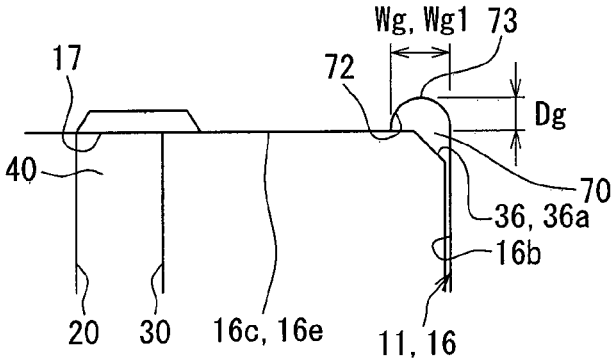
FIG. 11 is a view of a first modification corresponding to FIG. 6.

Specifically, as a first modification, as shown in FIG. 11, the annular groove 72 may be formed in a semicircle shape in the cross-section, which is an example where the bottom 73 of the annular groove 72 has an arc shape in the cross-section. In this example, the width dimension Wg1 is just twice of the depth dimension Dg.

Figure 12:
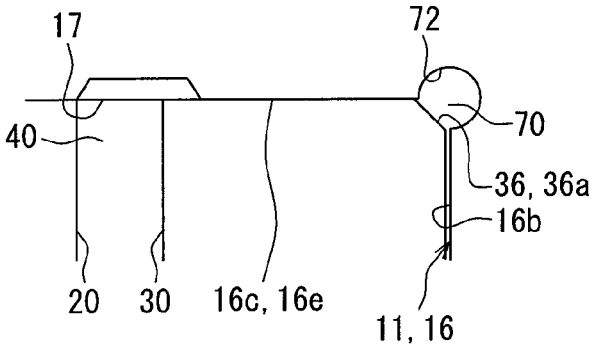
FIG. 12 is a view of an example of a second modification corresponding to FIG. 6.
Figure 13:
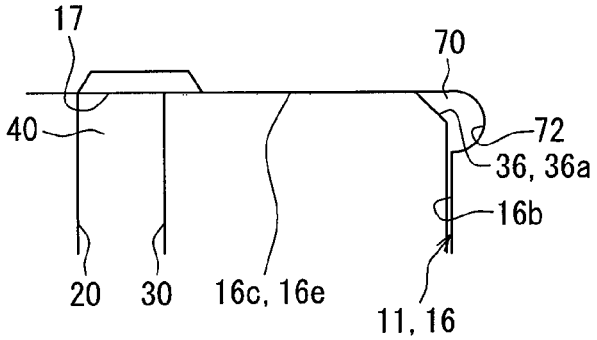
FIG. 13 is a view of another example of the second modification corresponding to FIG. 6.

As a second modification, the annular groove 72 may be recessed in a direction other than the axial direction Da. The annular groove 72 of FIG. 12 is recessed in the slant direction. In this case, when the position of the outer gear 30 is displaced, it becomes possible to apply the action pressure to the outer gear 30 along the slant direction. The annular groove 72 of FIG. 13 is recessed in the radial direction. In this case, when the position of the outer gear 30 is displaced, it becomes possible to apply the action pressure to the outer gear 30 along the radial direction.

As a third modification, the bottom 73 of the annular groove 72 may be formed in a rectangle shape.

As a fourth modification, the pump housing 11 may have the annular groove 72 at the respective sides of the gear housing chamber 56 in the axial direction Da. In this case, it is not necessary to form the joint housing chamber 58.

As a fifth modification, the fuel pump 100 may draw and discharge gasoline other than light oil, or liquid fuel similarly to this, as fuel.

The invention claimed is:

1. A fuel pump comprising:

an outer gear having a plurality of inner teeth;

an inner gear having a plurality of outer teeth and eccentrically meshing with the outer gear;

a rotation shaft that is driven to rotate;

a joint component that connects the rotation shaft to the inner gear to transmit a driving force of the rotation shaft to the inner gear;

a thrust bearing that supports the rotation shaft in an axial direction; and a pump housing that defines a cylindrical gear housing chamber housing the outer gear and the inner gear from both sides in the axial direction such that the outer and inner gears are rotatable, wherein the pump housing has a pair of sliding surface parts against which the outer gear and the inner gear slide, wherein the outer gear and the inner gear rotate, while expanding and contracting volumes of a plurality of pump chambers formed between the outer gear and the inner gear, to sequentially draw fuel into each of the pump chambers through an intake passage and discharge through a discharge passage, and the pump housing has an annular groove formed in an annular shape opposing the outer gear and recessed in the axial direction from at least one of the pair of sliding surface parts to make an area on a radially outer side of the intake passage and an area on a radially outer side of the discharge passage communicate with each other, wherein the annular shape of the annular groove is formed uninterruptedly, the joint component rotates the outer gear and the inner gear;

the joint component is in contact with the thrust bearing;

the joint component has:

a main body fitted with the rotation shaft in a joint housing chamber, and an insertion part having a plurality of extended members respectively arranged at a plurality of locations positioned circumferentially around the rotation shaft, each of the plurality of extended members extending from the main body in the axial direction and being respectively inserted in insertion holes of the inner gear defined at a plurality of positions through a clearance; and the insertion holes pass through the inner gear in the axial direction and the insertion part of the joint component extends in the insertion holes in the axial direction.

2. The fuel pump according to claim 1, wherein the pump housing has the joint housing chamber housing the joint component, the joint housing chamber communicating with the gear housing chamber at one side of the gear housing chamber in the axial direction, and the annular groove is located opposite from the joint housing chamber through the gear housing chamber.

3. The fuel pump according to claim 1, wherein a bottom of the annular groove has an arc shape in cross-section.

4. The fuel pump according to claim 1, wherein the annular groove has a triangle shape in cross-section, which tapers off as extending toward a bottom of the annular groove.

5. The fuel pump according to claim 1, wherein the annular groove is recessed from the sliding surface part where the discharge passage is defined.

6. The fuel pump according to claim 1, wherein the intake passage and the discharge passage are located opposite from each other through the gear housing chamber.

7. The fuel pump according to claim 1, wherein the annular groove extends in a rotating direction.

* * * * *